US007834534B2

(12) United States Patent
Ibuki et al.

(10) Patent No.: US 7,834,534 B2
(45) Date of Patent: Nov. 16, 2010

(54) ILLUMINANT SUBSTRATE AND MANUFACTURING METHOD THEREOF AND IMAGE DISPLAY APPARATUS

(75) Inventors: Hiroaki Ibuki, Sagamihara (JP); Masahiro Yokota, Fukaya (JP); Masaaki Suzuki, Yokohama (JP); Keiji Suzuki, Yokohama (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 454 days.

(21) Appl. No.: 11/953,470

(22) Filed: Dec. 10, 2007

(65) Prior Publication Data

US 2008/0143244 A1 Jun. 19, 2008

(30) Foreign Application Priority Data

Dec. 14, 2006 (JP) ..... 2006-337011
Oct. 19, 2007 (JP) ..... 2007-272691

(51) Int. Cl.
*H01J 1/62* (2006.01)

(52) U.S. Cl. ..... 313/496; 313/461; 430/26

(58) Field of Classification Search ..... 313/495, 313/496, 461; 430/26, 27
See application file for complete search history.

(56) References Cited

U.S. PATENT DOCUMENTS

2007/0182313 A1* 8/2007 Nakamura et al. ..... 313/496
2007/0241658 A1 10/2007 Oyaizu et al.

FOREIGN PATENT DOCUMENTS

JP 2005-235700 9/2005
JP 2006-120422 5/2006

* cited by examiner

*Primary Examiner*—Karabi Guharay
(74) *Attorney, Agent, or Firm*—Fitzpatrick, Cella, Harper & Scinto

(57) ABSTRACT

An illuminant substrate includes a substrate, first and second light emitting members provided on the substrate, a first anode covering the first light emitting member, a second anode covering the second light emitting member, a resistor located between the first and second light emitting members and electrically connecting the first and second anodes, and a rib laminated on the resistor. A side face of the resistor facing the first light emitting member projects toward the first light emitting member further than a side face of the rib facing the first light emitting member, and a side face of the resistor facing the second light emitting member projects toward the second light emitting member further than a side face of the rib facing the second light emitting member. In addition, the side faces of the resistor facing the first and second light emitting members are forward tapered faces, the side face of the rib is a reverse tapered face, and the first anode and the second anode are physically divided by the rib.

7 Claims, 5 Drawing Sheets

ILLUMINANT SUBSTRATE AND MANUFACTURING METHOD THEREOF AND IMAGE DISPLAY APPARATUS

BACKGROUND OF THE INVENTION

1. Field of the Invention

The present invention relates to an image display apparatus for displaying an image by exciting a phosphor that is provided on one substrate and emitting a light thereof by means of an electron emitted from an electron emission element that is provided on another substrate facing the one substrate.

2. Description of the Related Art

In recent years, a flat image display apparatus such as a field emission display (FED) and an image display apparatus provided with a surface-conduction electron emission element (SED) has been known.

An example of the inner structures of conventional FED and SED is shown in FIG. 6. The conventional FED and SED have a vacuum package 4, in which peripheries of a face plate 2 and a rear plate (corresponding to "an electron source substrate" of the present invention) 3 that are arranged oppositely via a spacer 1 are joined with each other by a side wall of a rectangular-frame shape.

Then, on the inner surface of the face plate 2, a plurality of light emitting members (phosphors) and a metal back 6 to cover this are formed. On the other hand, on the inner surface of the rear plate 3, an electron emission element 7 for emitting en electron to excite a light emitting member that is formed on the face plate 2 and emit a light thereof is formed in response to each light emitting member. A voltage higher than that of the electron emission element 7 by several kV is applied to the light emitting member, and an electron (an electron beam) discharged from each electron emission element 7 is accelerated by this electric field. Accelerated electrons are irradiated to the corresponding light emitting member to excite the light emitting member and emit the light thereof.

As described above, in the FED and the SED, in order to accelerate the electron, a high voltage is applied between the adjacent face plate and rear plate, so that this frequently involves a problem about discharge. If discharge is caused, large current flows through the discharge parts and this gives a serious damage to the electron emission element.

Therefore, in order to solve the above-described problem due to discharge, a soft flash structure has been suggested by Japanese Patent Application Laid-Open No. 2006-120422. According to the soft flash structure, the current flowing upon generation of discharge is limited in such a manner that the metal back to cover the light emitting member on the face plate is electrically divided into small areas and a high resistance is given between respective divided areas.

SUMMARY OF THE INVENTION

The conventional soft flash structure has the following problem. If each light emitting member is electrically and completely divided, an anode potential should be applied to each light emitting member individually. Therefore, it is preferable to connect a predetermined number of light emitting members with each other via a high-resistant member. Here, in the structure to divide the metal back by a resistance rib, in order to assure connection of the metal back on the part that is needed to be electrically connected, it is necessary to align the light emitting member and the resistance rib with a high degree of accuracy. However, in the case of forming the light emitting member by a screen printing method, for example, it is difficult to align the light emitting member and the resistance rib with a high degree of accuracy.

The object of the present invention is to assure electric connection by a high-resistant member between two or more light emitting members to be electrically connected.

One of the illuminant substrates of the present invention has a substrate, first and second light emitting members provided on the substrate, a first anode to cover the first light emitting member, and a second anode to cover the second light emitting member. In addition, this illuminant substrate has a resistor that is provided between the first light emitting member and the second light emitting member so as to electrically connect the first anode with the second anode. Then, the edge of a first layer facing the first light emitting member projects toward the side face of the first light emitting member further than the edge of a second layer facing the first light emitting member.

One manufacturing method of the illuminant substrate of the present invention has a substrate, a plurality of anodes arranged on this substrate, and a resistor to electrically connect part of a plurality of anodes, and this manufacturing method includes a first step to provide the resistor having a side face of a forward tapered shape, a second step to provide a rib having a side face of a reverse tapered shape for electrically dividing the plurality of anodes, and a third step to deposit an anode material after the first and second steps.

Another one of the illuminant substrates of the present invention has a substrate, first and second light emitting members provided on the substrate, a first anode to cover the first light emitting member, a second anode to cover the second light emitting member, and a resistor that is provided between the first light emitting member and the second light emitting member so as to electrically connect the first anode with the second anode. This method includes a first step to provide a first layer to configure the resistor, a second step to laminate a second layer to configure the resistor on the first layer so that the edge of the first layer facing the first light emitting member projects toward the side face of the first light emitting member further than the edge of the second layer facing the first light emitting member, a third step to provide the first and second light emitting members, and a fourth step to provide an anode after the first to third steps.

The image display apparatus according to the present invention has the illuminant substrate of the present invention and an electron source substrate that is arranged facing the illuminant substrate and is provided with an electron emission element.

According to the present invention, it is possible to ensure electric connection due to a high-resistant member between the light emitting members being adjacent across the rib.

DESCRIPTION OF THE EMBODIMENTS

Next, one example of the illuminant substrate and the image display apparatus according to the present invention will be described. However, the basic structures of the illuminant substrate and the image display apparatus according to the present invention are the same as those of the conventional illuminant substrate and the image display apparatus. The illuminant substrate and the image display apparatus according to the present invention are mainly different from the conventional illuminant substrate and image display apparatus in the inner structure of the illuminant substrate (the face plate). Therefore, the explanation is omitted about the structures common with the conventional face plate and the image display apparatus and the inner structure of the face plate that is a characteristic of the present invention will be described in detail.

<Structure of Illuminant Substrate (Rear Plate Structure)>

Figure 1:
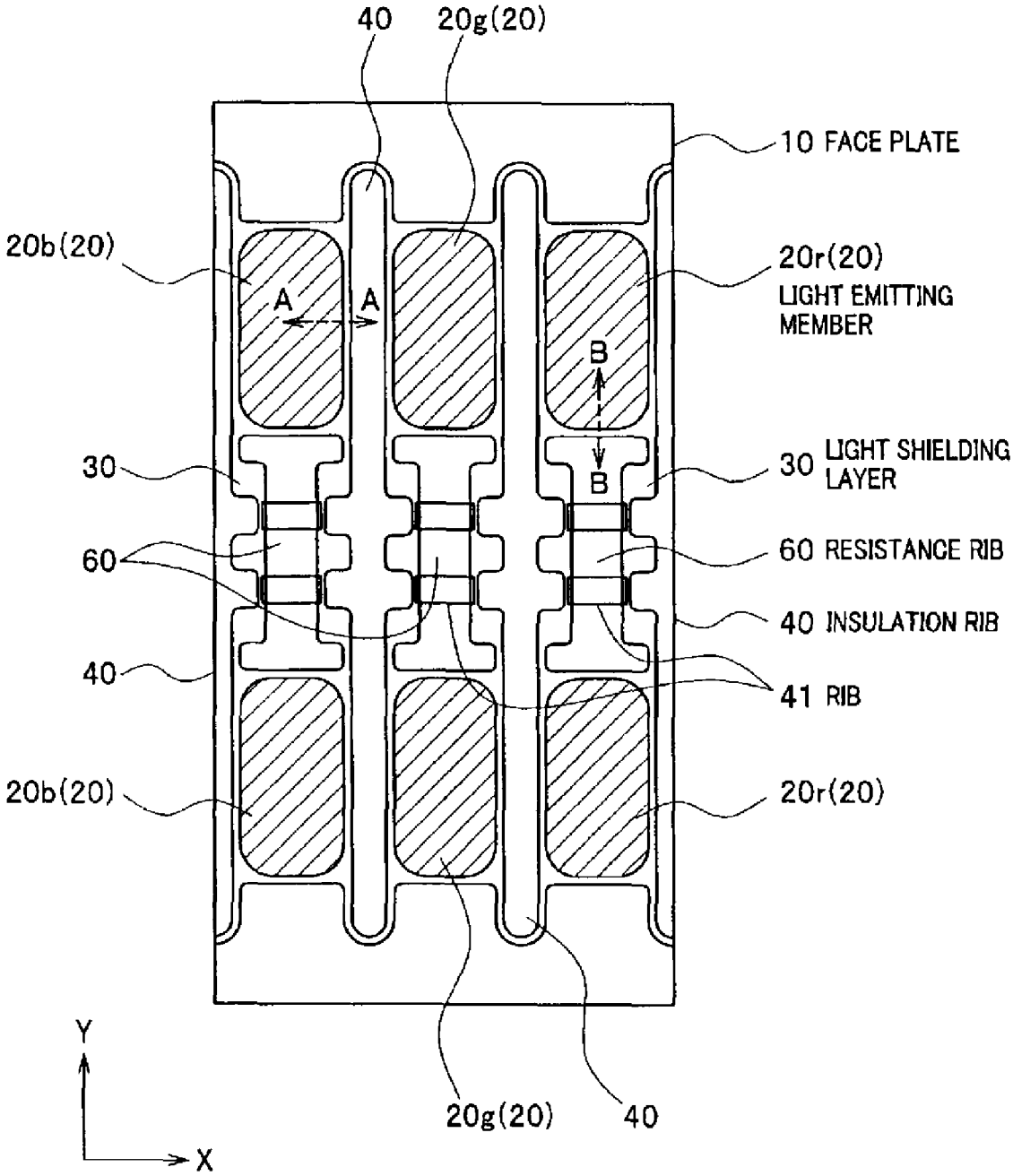
FIG. 1 is a partial enlarged plan view showing an inner structure of a face plate with which an image display apparatus according to the present invention equips.

FIG. 1 is a partial enlarged plan view showing an inner structure of a face plate with which an image display apparatus according to the present invention equips.

Figure 2A:
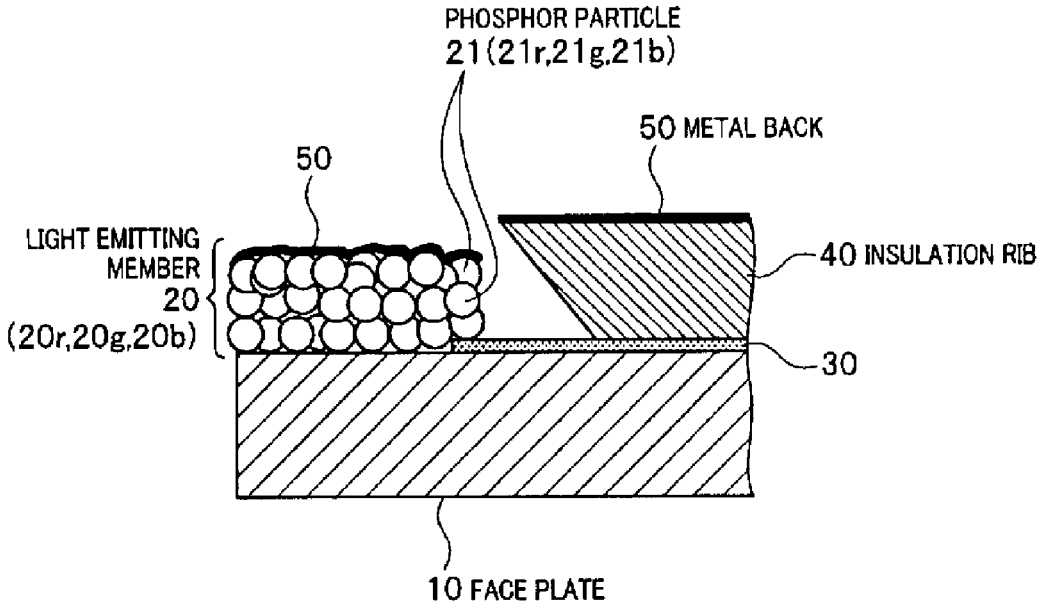
FIG. 2A is a cross sectional view taken on a line A-A of FIG. 1.
Figure 2B:
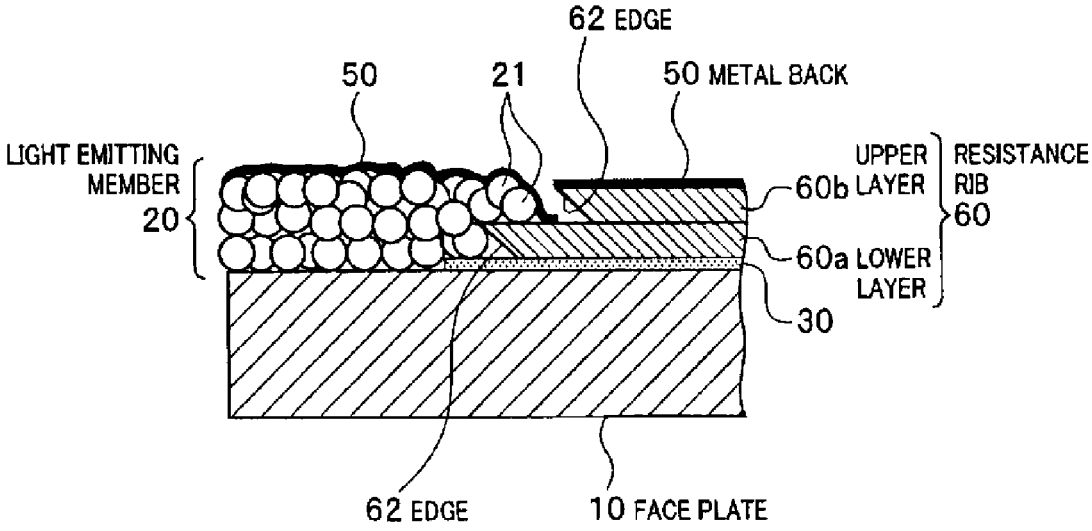
FIG. 2B is a longitudinal sectional view taken on a line B-B of FIG. 1.

FIG. 2A is a cross sectional view taken on a line A-A of FIG. 1 and FIG. 2B is a longitudinal sectional view taken on a line B-B of FIG. 1. However, as a matter of convenience, a part of the structure shown in FIG. 1 may be omitted in FIGS. 2A and 2B. In addition, the structures shown in FIGS. 2A and 2B may be partially omitted in FIG. 1.

As shown in FIG. 1, on the inner surface of the face plate 10 (corresponding to "the substrate" of the present invention), light emitting members 20*r*, 20*g*, and 20*b* made by phosphor particles 21*r*, 21*g*, and 21*b* (refer to FIG. 2) of R (Red), G (Green), and B (Blue) are formed in a matrix. Further, around respective light emitting members 20, a light shielding layer 30 is formed. Then, the light emitting members 20 adjacent to an X direction (a lateral direction) in the drawing are electrically divided by an insulation rib 40 that is formed between respective light emitting members 20. Specifically, as shown in FIG. 2A, by dividing a metal back 50 to be formed on the light emitting member 20 and the insulation rib 40 by using a step between the light emitting member 20 and the insulation rib 40, respective light emitting members 20 are electrically divided.

On the other hand, the light emitting members 20 (corresponding to "the first light emitting member" and "the second light emitting member" of the present invention) adjacent in a Y direction (a longitudinal direction) in FIG. 1 are connected via the metal back 50 (corresponding to "the anode" according to the present invention). Specifically, the resistance rib 60 (corresponding to "the resistor" according to the present invention) is formed between respective light emitting members 20 adjacent in the Y direction.

In this case, as shown in FIG. 2B, the resistance rib 60 has a two-layered structure made of a lower layer 60*a* (corresponding to "the first layer" of the present invention) and an upper layer 60*b* (corresponding to "the second layer" of the present invention). Further, the lower layer 60*a* is located closer to the light emitting member 20 than the upper layer 60*b* is located. Accordingly, the longitudinal section of the resistance rib 60 (the B-B section of FIG. 1) has a step-like form as shown in FIG. 2B. As a result, the light emitting member 20 is formed such as some of the phosphor particles 21 are mounted on the lower layer 60*a*, so that there is no large step generated between the light emitting member 20 and the resistance rib 60. Accordingly, when a metal back material is deposited on the light emitting member 20 and the resistance rib 60, the metal back 50 is formed between the light emitting member 20 and the resistance rib 60 without an interruption.

According to the present embodiment, it is defined that the particle diameter of the phosphor particle 21 is about 5 μm, the height (the thickness) of the light emitting member 20 is in the range of 10 to 15 μm, and the height of the resistance rib 60 with the lower layer 60*a* and the upper layer 60*b* is about 10 μm. Particularly, the thinner the height (the thickness) of the lower layer 60*a* is, the easier the phosphor particle 21 is mounted on the lower layer 60*a*, so that it is preferable that the height of the lower layer 60*a* is not more than 5 μm, for example. Further, the height (the thickness) of the phosphor is related to the luminance and the height of the resistance rib is related to the resistance value. Therefore, it may be difficult in fact to align the height of the phosphor with the height of the resistance rib.

In addition, according to the present embodiment, the two-layered structure is described; however, the present invention is not limited to this. In other words, even if the resistance rib is made of a three or more layered structure, when the resistance rib is formed so that some of the phosphor particles are mounted on the lower layer, the advantage of the present invention is realized.

Further, in FIG. 2B, the metal back 50 formed on the upper layer 60*b* is physically divided from the metal back 50 ("the first anode" of the present invention) formed from the light emitting member 20 ("the first light emitting member" of the present invention) over the lower layer 60*a* without an interruption. Therefore, the metal back 50 formed on the upper layer 60*b* is also physically divided from the metal back 50 ("the second anode" of the present invention) formed from the light emitting member 20 ("the second light emitting member" of the present invention) adjacent in the Y direction in FIG. 1 over the lower layer 60*a* without an interruption. However, electric connection for these metal backs 50 ("the first anode" and "the second anode" of the present invention) is assured via the resistance rib 60 (the lower layer 60*a* and the upper layer 60*b*).

In the above-described FIG. 2B, it can be said that an edge 62 of the lower layer 60*b* facing the light emitting member 20 projects toward the side face of the light emitting member 20 further than the edge 62 of the upper layer 60*a* facing the light emitting member 20.

Figure 3:
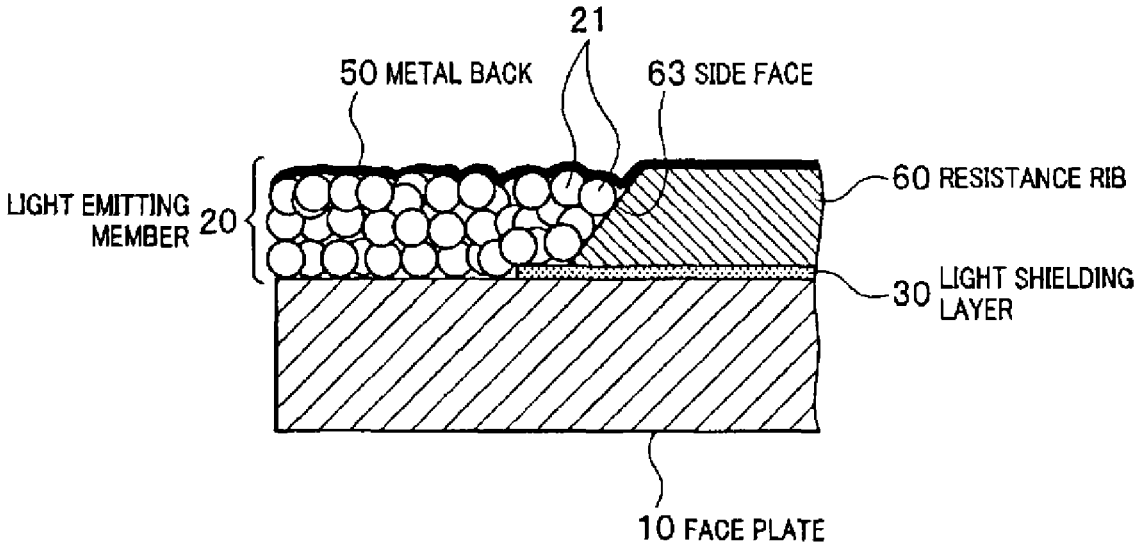
FIG. 3 is a partial sectional view showing a modified example of a resistance rib shown in FIG. 1.
Figure 4:
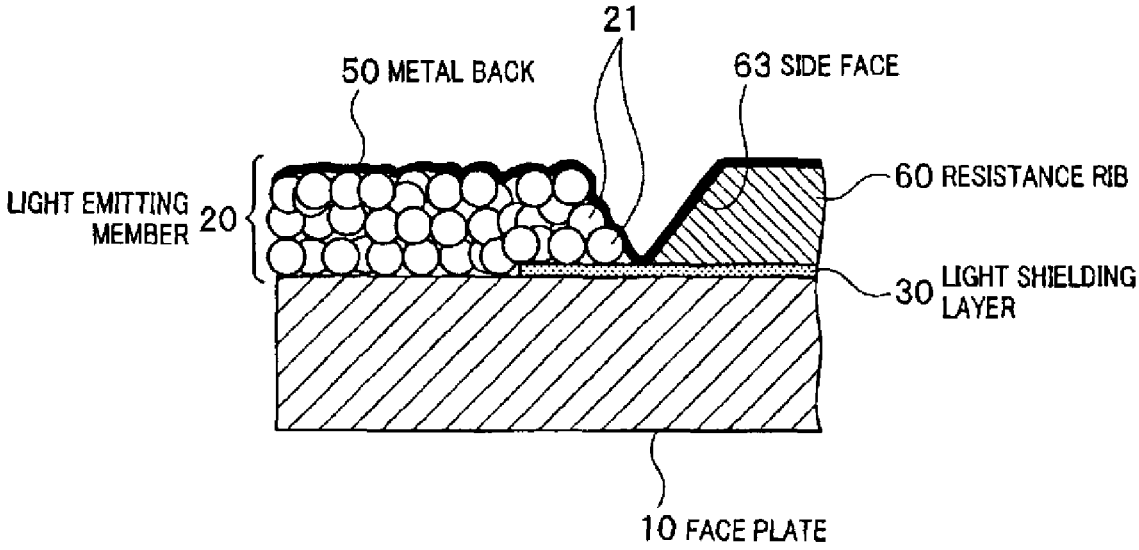
FIG. 4 is a partial sectional view showing a modified example of a resistance rib shown in FIG. 1.

As a shape of the resistance rib for reliably preventing disconnection caused by step of the metal back over two and more light emitting members to be electrically connected, the shapes shown in FIG. 3 and FIG. 4 are cited as an example in addition to the shape shown in FIG. 2B.

The resistance rib 60 shown in FIG. 3 is inclined so as to move backward in a direction separated from the light emitting member 20 as the side face 63 facing the light emitting member 20 separates from the inner surface of the face plate 10. The face inclined as shown in FIG. 3 is referred to as a forward tapered face. On the other hand, the face inclined in the opposite direction from the above direction is referred to as a reverse tapered face. Accordingly, the edge 62 of the resistance rib 60 shown in FIG. 2B is a reverse tapered face.

According to the present example, the side face 63 of the resistance rib 60 facing the light emitting member 20 is the forward tapered face, so that the light emitting member 20 is formed so that some of the phosphor particles 21 are mounted on the side face 63. Therefore, there is no large step generated between the light emitting member 20 and the resistance rib 60. Accordingly, when a metal back material is deposited on the light emitting member 20 and the resistance rib 60, the metal back 50 is formed between the light emitting member 20 and the resistance rib 60 without an interruption.

The resistance rib 60 shown in FIG. 4 has the same sectional shape as the resistance rib 60 shown in FIG. 3. In other words, the side face 63 facing the light emitting member 20 is a forward tapered face. The resistance rib 60 shown in FIG. 4 is different from the resistance rib 60 shown in FIG. 3 in that it moves backward from the edge of the light shielding layer 30 in a direction separated from the light emitting member 20 (a right direction on a paper face) as compared to the resistance rib 60 shown in FIG. 3. As a result, a gap is generated between the side face 63 of the resistance rib 60 shown in FIG. 4 and the end face of the light emitting member 20 facing this side face 63, so that the light shielding layer 30 is partially exposed. This leads to the fact that the metal back material is deposited not only on the light emitting member 20 and the resistance rib 60 but also on the light shielding layer 30. Accordingly, a series of metal back 50 across the light emitting member 20, the light shielding layer 30, and the resistance rib 60 are formed without an interruption. Only if the light shielding layer 30 is exposed between the side face 63 of the resistance rib 60 and the end face of the light emitting member 20, this is not changed even when the interval between the both is opened more than the illustrated gap. In other words, with respect to variation of a film thickness of the light emitting member 20 and the resistance rib 60 and variation of the accuracy of a position, the structure shown in FIG. 4 is more excellent than that shown in FIG. 3.

In the case of the embodiment shown in FIG. 3 and FIG. 4, the metal backs provided on respective phosphors adjacent to the Y direction are electrically connected with each other via the resistance rib 60. However, the metal backs provided on respective phosphors adjacent to the Y direction are physically divided by a rib 41 formed on the resistance rib 60.

The phosphor particle 21 has a larger particle diameter as compared to the film thickness thereof, so that when using a normal screen printing and a photolithography, the area of the upper face (the surface of the light emitting member 20) is not made larger than the area of the lower face (the face contacting the face plate 10). Therefore, the metal back 50 on the light emitting member 20 is not divided from the metal back 50 on the light shielding layer 30.

In the above-described FIG. 3 and FIG. 4, it can be said that an angle of the portion shared by the resistance rib 60 in the angle made by the side face 62 of the resistance rib 60 facing the light emitting member 20 against the surface of the face plate 10 is a sharp angle.

In addition, as described above, the present embodiment is configured so that the height of the resistance rib is lower than the height (the thickness) of the light emitting member. However, when the height of the resistance rib is higher than the height (the thickness) of the light emitting member, a problem about disconnection caused by step is easily caused. Therefore, it is also possible to apply the present invention in the configuration that the height to the surface of the light emitting member is higher than the height of the resistance rib. In this case, the height (the thickness) can be obtained by measuring an average height by taking a picture of a cross section SEM (SEM Cross Section) near the center in the X direction of the light emitting member 20 like the B-B sectional view of FIG. 1, for example.

<Manufacturing Method of Illuminant Substrate>

Next, a method of forming a resistance rib, which has been described so far, will be described below. Generally, in the case of forming a high-defined and complicated pattern, a photolithography method is employed. According to the photolithography method, a printing paste including a photoresist is printed on the entire surface of the substrate by using a screen printing plate. Consequently, by performing exposure and development by using a photomask having a desired pattern formed, the pattern is formed.

In the case of forming the resistance rib according to the photolithography method, the side face can be made into the reverse tapered face by using a difference of a resist reaction rate between the printing paste surface of an exposed portion and the rear face of the printing paste (namely, the face contacting the face plate). Therefore, the resistance rib 60 of FIG. 2B having the edge 62 that is the reverse tapered face can be formed according to the photolithography method. Further, the lower layer 60*a* and the upper layer 60*b* shown in FIG. 2B can be easily formed by using different photomasks, respectively. In addition, an angle (a taper angle) of the side face 62 can be adjusted by changing resist sensitivity, an exposure time, and a development condition.

In this way, by providing the lower layer 60*a* (the first layer) and further, providing the upper layer 60*b* (the second layer) on this lower layer 60*a* (the first layer), the resistance rib 60 can be obtained, which is shown in FIG. 2B. In other words, it is possible to laminate the lower layer 60*a* and the upper layer 60*b* so that the edge 62 of the lower layer 60*a* (the first layer) facing the light emitting member 20 projects toward the side face of the light emitting member 20 further than the edge 62 of the upper layer 60*b* (the second layer) projects.

Further, the light emitting member may be provided after laminating the first layer and the second layer or the light emitting member may be provided after providing the first layer and then, the second layer may be laminated.

On the other hand, in the case of forming a resistance rib by pasting a printing paste on a pattern that is formed by a mesh and an emulsion and squeegeeing it, the printing paste flows behind the emulsion, so that the side face of the resistance rib is made into the forward tapered face. Therefore, the resistance rib 60 shown in FIG. 3 and FIG. 4 having the side face 63 that is the forward tapered face can be formed by using such a method.

With reference to FIG. 5, a method of forming the resistance rib 60 shown in FIG. 3 will be specifically described. At first, as shown in FIG. 5A, the light shielding layer 30 is formed on the inner face of the face plate 10. On the light shielding layer 30, an opening is formed on the position where the light emitting member 20 is intended to be formed.

Figure 5A:
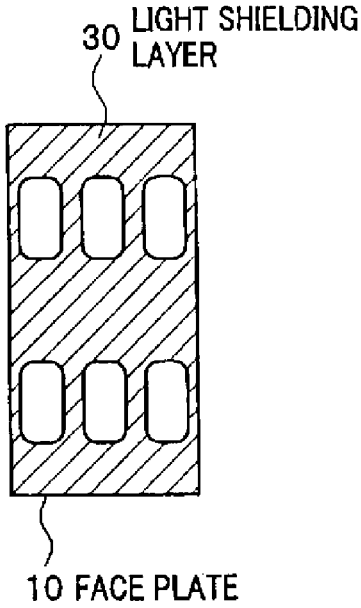
FIG. 5 is a partial enlarged plan view showing a step for forming the resistance rib shown in FIG. 3.
Figure 5B:
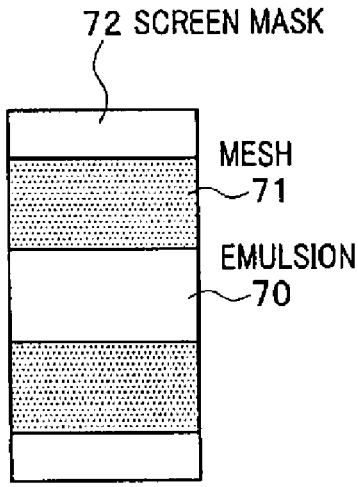
Figure 5C:
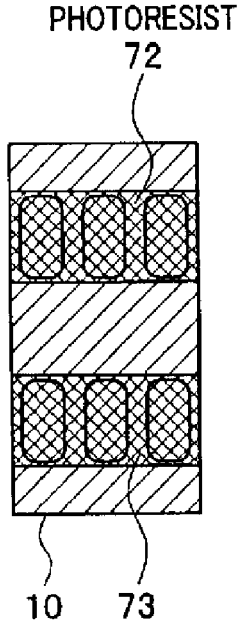
Figure 5D:
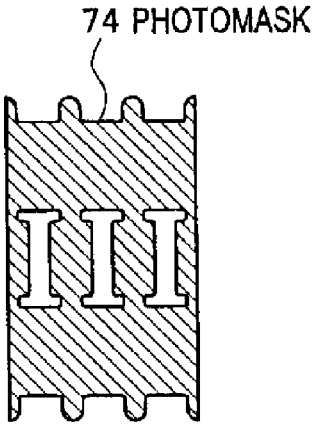
Figure 5E:
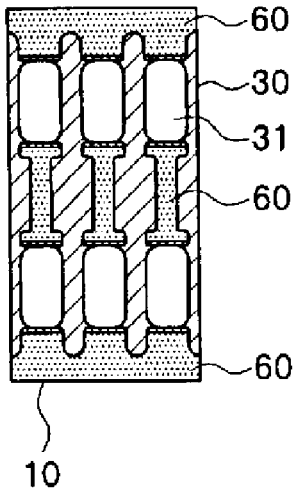

Next, as shown in FIG. 5B, a screen mask 72 which is configured by an emulsion 70 and a mesh 71 is prepared. By using this screen mask 72, printing a photoresist 73 with the positional relation with the face plate 10 of FIG. 5A kept, the state shown in FIG. 5C is obtained. In this case, the photoresist 73 is a printing paste including a photoresist. Next, by using a photomask 74 shown in FIG. 5D, keeping the positional relation with the substrate in the state shown in FIG. 5C, exposure and development are carried out. In this case, exposure and development are carried out under the condition that the side face is the reverse tapered shape. Then, as shown in FIG. 5E, although the side face of the resistance rib 60 is made into the reverse tapered face except for a shaded area, the side face of the shaded area is made into the forward tapered face because the above-describe property of the screen printing is maintained.

In this way, the resistance rib 60 can be provided so that the angle on the portion shared by the resistance rib 60 in the angle made by the side face 63 of the resistance rib 60 facing the light emitting member 20 against the surface of the face plate 10 is made into a sharp angle.

Subsequently, the light emitting member 21 is configured on the opening by the printing method, and then, by depositing the metal back 50 (the anode), the illuminant substrate can be manufactured.

Figure 6:
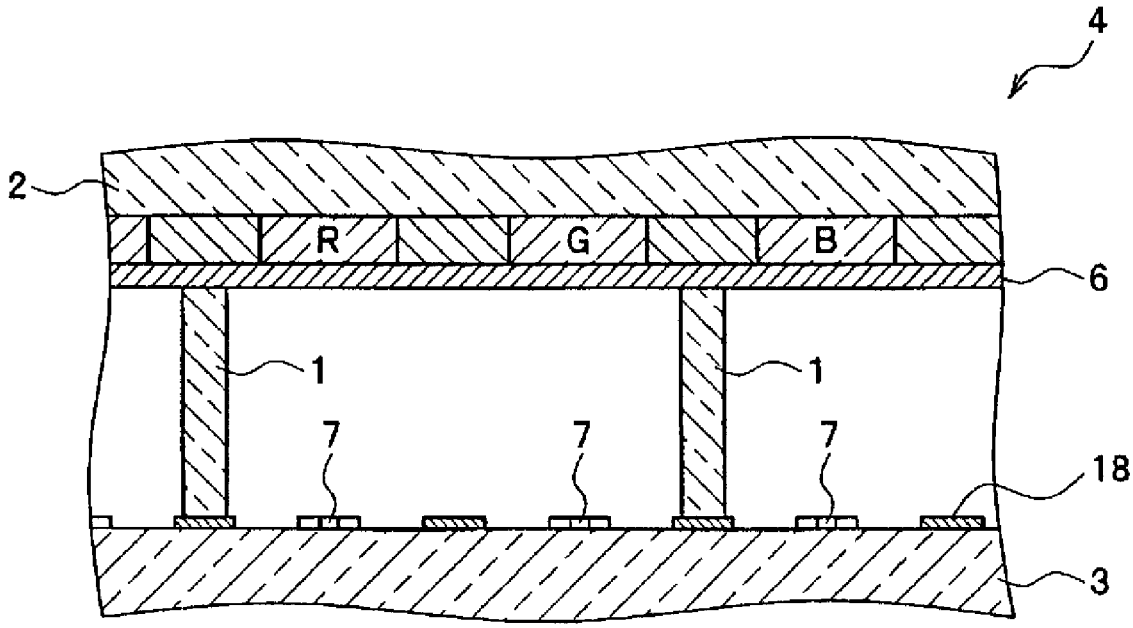
FIG. 6 is a partial sectional view showing the inner structure of a conventional plane type image display apparatus.

Further, by manufacturing the rear plate (the electron source substrate) provided with the electron emission element as shown in FIG. 6 and combining the illuminant substrate with the electron source substrate, the image display apparatus can be manufactured.

Although the present embodiment is configured so that the light emitting member is provided after providing the resistance rib, the present invention is not limited to this. In other words, as shown in FIG. 4, in the case that the embodiment is configured in such a manner that a gap is generated between the side face 62 of the resistance rib 60 and the end face of the light emitting member 20 facing this and the light shielding layer 30 is partially exposed, the resistance rib may be provided after providing the light emitting member 20.

Further, in the case of the embodiment shown in FIG. 3 and FIG. 4, the rib 41 may be formed on the resistance rib 60 under the condition that the side face becomes the reverse tapered shape before the metal back 50 is deposited.

Since the electron source substrate in the image display apparatus according to the present invention is the same as the conventional electron source substrate, the description of the structure and the manufacturing method thereof will not be described herein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-337011, filed on Dec. 14, 2006, and No. 2007-272691, filed on Oct. 19, 2007 which are hereby incorporated by reference herein in their entirety.

What is claimed is:

1. An illuminant substrate comprising:

a substrate;

first and second light emitting members provided on the substrate;

a first anode covering the first light emitting member;

a second anode covering the second light emitting member;

a resistor located between the first and second light emitting members and electrically connecting the first and second anodes; and a rib laminated on the resistor;

wherein a side face of the resistor facing the first light emitting member projects toward the first light emitting member further than a side face of the rib facing the first light emitting member, a side face of the resistor facing the second light emitting member projects toward the second light emitting member further than a side face of the rib facing the second light emitting member, the side faces of the resistor facing the first and second light emitting members are forward tapered faces, the side face of the rib is a reverse tapered face, and the first anode and the second anode are physically divided by the rib.

2. An illuminant substrate according to claim 1, wherein height from a surface of the substrate to a surface of the first and second light emitting members is lower than height from the surface of the substrate to a surface of the resistor.

3. An image display apparatus comprising:

illuminant substrate according to claim 1; and an electron source substrate facing the illuminant substrate and having an electron emission element.

4. An illuminant substrate according to claim 1, wherein the first light emitting member comprises a plurality of phosphor particles, and part of the phosphor particles are mounted on the side face of the resistor facing the first light emitting member; and the second light emitting member comprises a plurality of phosphor particles, and part of the phosphor particles are mounted on the side face of the resistor facing the second light emitting member.

5. A manufacturing method of an illuminant substrate comprising a substrate, a plurality of anodes provided on the substrate, and a resistor that electrically connects part of the plurality of anodes, the method comprising the steps of:

(a) providing a resistor having first and second side faces of a forward tapered face;

(b) providing a rib, having a reverse tapered face, on the resistor and between the first side face and the second side face, in order to electrically separate at least two anodes among the plurality of the anodes;

(c) providing a first light emitting member and a second light emitting member so that the resistor and the rib are located between the first light emitting member and the second light emitting member; and (d) depositing a material for forming a metal back on the resistor, the rib, and the first and second light emitting members after exceeding steps (a) to (c).

6. A manufacturing method of an illuminant substrate according to claim 5, wherein the first light emitting member comprises a plurality of phosphor particles, and part of the phosphor particles are mounted on the side face of the resistor facing the first light emitting member; and the second light emitting member comprises a plurality of phosphor particles, and part of the phosphor particles are mounted on the side face of the resistor facing the second light emitting member.

7. A manufacturing method of an image display apparatus comprising an illuminant substrate and an electron source substrate that faces the illuminant substrate and has an electron emission element, the method comprising the steps of:

preparing an illuminant substrate according to claim 5; and preparing an electron source substrate with an electron emission element.

* * * * *